United States Patent [19]

Lesage et al.

[11] Patent Number: 4,773,263

[45] Date of Patent: Sep. 27, 1988

[54] METHOD OF ANALYZING VIBRATIONS FROM A DRILLING BIT IN A BOREHOLE

[75] Inventors: Marc Lesage, Missouri City, Tex.; Michael Sheppard, Shudy Camps, England

[73] Assignee: Schlumberger Technology Corporation, Houston, Tex.

[21] Appl. No.: 901,073

[22] Filed: Aug. 28, 1986

[30] Foreign Application Priority Data

Aug. 30, 1985 [GB] United Kingdom ..... 8521671

[51] Int. Cl.[4] ..... E21B 45/00

[52] U.S. Cl. ..... 73/151; 73/659; 73/660; 175/39

[58] Field of Search ..... 73/151, 151.5, 659, 73/660; 175/39

[56] References Cited

U.S. PATENT DOCUMENTS

| | | | |
|---|---|---|---|
| 2,985,829 | 5/1961 | Swift | 73/151 |
| 3,345,867 | 10/1967 | Arps | 73/151 |
| 3,703,096 | 11/1972 | Vitter, Jr. et al. | 73/151 |
| 3,714,822 | 2/1973 | Lutz | 73/660 X |
| 3,774,445 | 11/1973 | Rundell | 73/151 |
| 3,782,190 | 1/1974 | Pittman | 73/151 |
| 4,150,568 | 4/1979 | Berger et al. | 73/151 |
| 4,549,431 | 10/1985 | Soelinah | 73/151 |

FOREIGN PATENT DOCUMENTS

| | | | |
|---|---|---|---|
| 1191565 | 11/1985 | U.S.S.R. | 73/151.5 |

OTHER PUBLICATIONS

F. H. Deily et al., New Drilling-Research . . . Hole, Oil and Gas Journal, 1-8-68, pp. 55-64.

*Primary Examiner*—Stewart J. Levy
*Assistant Examiner*—Kevin D. O'Shea
*Attorney, Agent, or Firm*—Mary M. Yawney; Stephen L. Borst

[57] ABSTRACT

Information on tooth wear is obtained from the frequency distribution spectrum of a vibrational quantity influenced by the impact of cutter teeth on the bottom of a bore. For example, spectra may be obtained from the product of signals indicative of torque and torsional acceleration. Tooth wear is then indicated by the shift upwardly in frequency of peaks in the spectra. Other quantities which may be used, singly or together to enhance spectral information, are weight on bit, vertical acceleration, transverse acceleration, standpipe pressure. Abrupt changes in frequency distribution curves indicate abrupt occurrences such as broken teeth or stuck cones. A stuck cone is also indicated by unidirectional peaks in a plot of torsional acceleration against time.

14 Claims, 7 Drawing Sheets

METHOD OF ANALYZING VIBRATIONS FROM A DRILLING BIT IN A BOREHOLE

BACKGROUND OF THE INVENTION

The present invention relates to a method of analyzing the vibrations from a drilling bit in a borehole so as to obtain information useful in managing the drilling operation.

By way of background it will be helpful first to explain the nature of a typical drilling bit. A plurality of cutters are mounted on radial axes so as to grind against the bottom of the borehole as the bit is rotated by the drill string. The cutters may have integral hardened steel teeth, which are prone to wear, or inserted teeth or studs which are highly resistant to wear. Teeth and studs may break. The bearings of the wheels are subject to wear. The teeth on a wheel are so disposed that they cannot all roll on the bottom of the borehole; instead they are forced to tear aggressively against the rock. Thus the cutters may be cones with a plurality of circumferential rows of teeth whose pitch diameters are not proportional to radial distance from the longitudinal axis of the bit. The most common bit is a tri-cone bit.

As the teeth bite against the rock one after another, they generate noise with frequency components determined by the rates at which teeth successiovely encounter the rock. It has already been appreciated that lithological information is given by the vibrational noise. At a very simple level, the harder the rock, the louder the noise. It is proposed in U.S. Pat. No. 3,626,482 (a development of U.S. Pat. No. 3,520,375) to measure the amplitude of vibrations in a frequency band or window centered on a multiple of the speed of rotation of the bit. This multiple is intended to take account of the number of "attacking elements" which are carried by the tool. Logs based on this technology have been but are no longer used by drilling companies. The above references propose detecting the vibrational energy at the top of the string or in the vicinity of the bit, in which case amplitude is transmitted up the borehole by the well known technique of mud-pulsing.

Although it is very useful to have rock hardness information since, in general, weight on bit (WOB) should be varied in proportion to rock hardness, it has now been appreciated firstly that the prior art proceeds upon an incorrect assumption and secondly that much more information can be obtained from the vibrations.

To take one important example, information regarding tooth wear could contribute significantly to the economically efficient management of a borehole. To pull out a string and replace a bit is a time-consuming operation which should desirably be conducted only at "correct" intervals, i.e. only when strictly necessary. If, to be on the safe side, a string ispulled out prematurely to change (or check) the bit, an unnecessarily high number of down days over the drilling period will result. If the bit is used for too long, at best there will be a period of inefficient drilling (maybe with a broken tooth or teeth). At worst there may be catastrophic failure with loss of a wheel, which then has to be fished out after the string has been pulled out.

SUMMARY OF THE INVENTION

In a preferred embodiment of the present invention, one or more transducers sense physical quantities associated with the drill bit and output signals from which an oscillatory signal is derived by means such as a multiplexed sampling analog-to-dgital converter. From this oscillatory signal, a frequency spectrum is derived and monitored for changes therein.

According to the present invention in one aspect, it has been appreciated that considerable information is obtainable from the frequency spectrum of the vibrational noise. This spectrum, can be obtained by collecting vibrational data (preferably averaged over a number of measurement periods) and processing it through a Fourier transform, preferably a discrete Fourier transform (DFT).

The frequency spectrum will be found to include various significant peaks which pertain to different tooth rows of the bit. The amlitude ofpeaks are correlated with rock hardness but it has been found that the frequencies of the peaks are not constant (so that the window technique of the prior art is not soundly based). Peak frequencies tend to increase as teeth wear, because the mean speed of a cutter (normalized relaitve to bit speed) tends to increase. Therefore the shift of peak frequencies gives useful information on wear and hence whether it is yet time to pull out the string.

Furthermore, abrupt changes in the form of the frequency spectrum are indicative of abrupt occurrences at the bit such as loss of a tooth. This may lead to the appearance of a new peak as an unbroken tooth is forced to take over the work previously done by the broken tooth. Loss of frequency peaks indicate that a wheel has stuck or is clogged by a ductile rock.

It is at present preferred to make measurement near the bit using an MWD (measurement while drilling) subsection of drill collar (sub) because frequency peaks may be expected then to be reasonably sharp. Measurements may alternatively be made at the top of the string, using the vibrations transmitted through the string or through the mud. There will then have been considerable dispersion, especially if there are shock isolating subs in the string. Nevertheless the amount of processing power now available to process large volumes of data, obtained over many hundreds of rotations of the bit, may still enable significant spectral information to be extracted.

At the top of the string, rotational speed is substantially constant. At the bottom there is some fluctuation because the string acts as a torsional pendulum. This will tend to produce spectral eaks with side-bands which, at the top of the string are blurred into spread peaks. Te shift of peak centre frequency may nevertheless be detectable.

Tooth noise is created essentially by forced vibrations. Any very large spectral peaks can be eliminated as they will arise from resonant rather than forced vibrations, in particular from drill string resonances.

In further contrast to the prior art, it is highly desirable to look at information in a plurality of channels. These may be different frequency bands. If attention is concentrated on one narrow frequency band there is a risk that there will be confusion as to which peak a given set of measurements pertain and consequently a risk of false comparison, e.g. comparison between peak amplitudes. This risk arises in particular because, as noted above, the peaks shift with time as the bit wears.

Further according to the invention in another aspect, two different measurements are combined or compared with one another in order to enhance the information obtained by analysis. The measurements may be multiplied together before application of the DFT to enhance the spectral peaks. The fluctuating signals which are commonly available for analysis from standard acquisition techniques are torque on the string, torsional acceleration (or angular acceleration), WOB and vertical acceleration. Other signals which may be employed are standpipe pressure and transverse acceleration or stress. Reference may be had to the early article entitled "New Drilling-research Tool Shows What Happens Down Hole" which appeared in *The Oil and Gas Journal,* Jan. 8, 1968 for a description of a typical apparatus and techniques for obtaining signals of many of the parameters useful in the practice of this invention. Those skilled in the art will recognize that other parameters are available from other common techniques of which they would be aware.

Comparison may also be made with quite different signals, especially rate of penetration ROP which is desirably normalized relative to WOB. If the vibrational analysis indicates a hard rock and ROP is low, a typical tough rock (e.g. dolomite) is indicated. However, an indicated hard rock with ROP high indicates a hard but brittle rock, which is easily shattered by impact. If the vibrational analysis indicates a soft rock and ROP is high, easy drilling in shale is indicated. On the other hand if ROP is low a ductile or pseudo-ductile behaviour of the rock is indicated. Comparison may also be made with static (average) load or static (average) torque.

Static torque can be correlated with torsional acceleration. If one wheel is stuck, static torque increases and there are unidirectional peaks in the torsional acceleration.

DETAILED DESCRIPTION OF THE DRAWINGS

Figure 1:
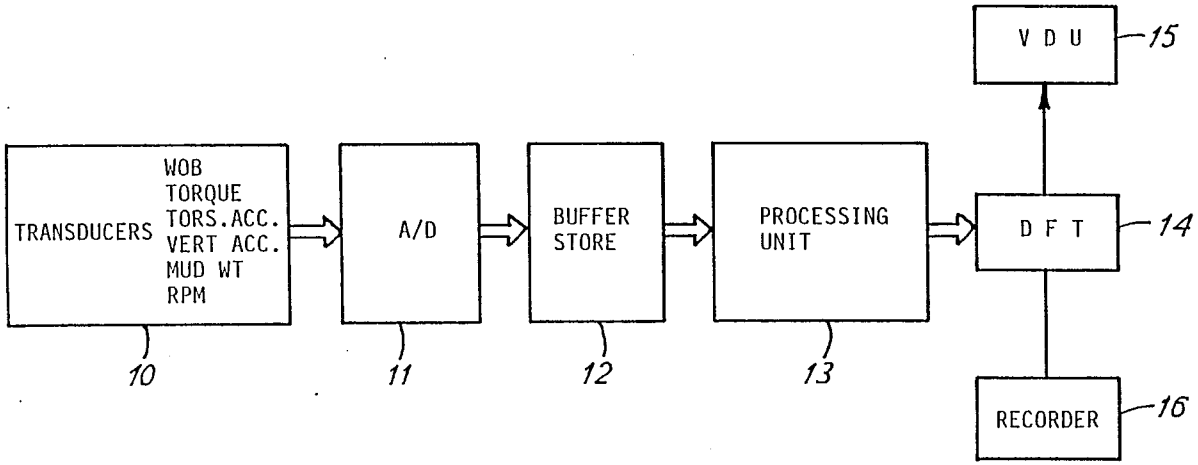

The invention will now be described in more detail, by way of example, and with reference to the accompanying drawings, in which:

FIG. 1 is a schematic diagram of apparatus for use in performing the invention, FIGS. 2 to 7 are experimental curves of various kinds.

DETAILED DESCRIPTION OF THE PREFERRED EMBODIMENT

The individual items of the apparatus shown in FIG. 1 are all well known and will not be described in detail. Block 10 represents an assemblage of transducers providing signals representing the following quantities, for example:

WOB (kN)
Torque (N.m)
Torsional acceleration (rad.s$^{-2}$)
Vertical acceleration (m.s$^{-2}$)
Mud weight (kN) [Standpipe pressure (Pa)]
String rate of rotation (rpm)

A multiplexed sampling analog-to-digital converter 11 provides digital samples of all the above quantities, which are fed into a buffer store 12 in which the samples are held for a period T of some seconds. Thus the store has a channel for each quantity and a number of bins in each channel to hold a few hundred samples taken at intervals of the order of a millisecond. In each successive period T the new samples are written into the appropriate bins with digital integration of the form NEW=(1−x) (OLD)+x (NEW SAMPLE) where x is a fractional value, (Leaky bucket integration).

The buffered quantities are applied to a processing unit 13 which attends to such requirements as normalization and may perform a simple sampel by sample multiplication of two quantities, or some more sophisticated correlation function. One or more processor or unprocessed quantities are then applied to a DFT analyser 14 whose output may be displayed on a VDU 15 or recorded on a recorder 16.

The following curves were all obtained from an experimental rig using directly driven tri-cone bits. The curves do not therefore exhibit any string resonances or string dispersion.

Figure 2:
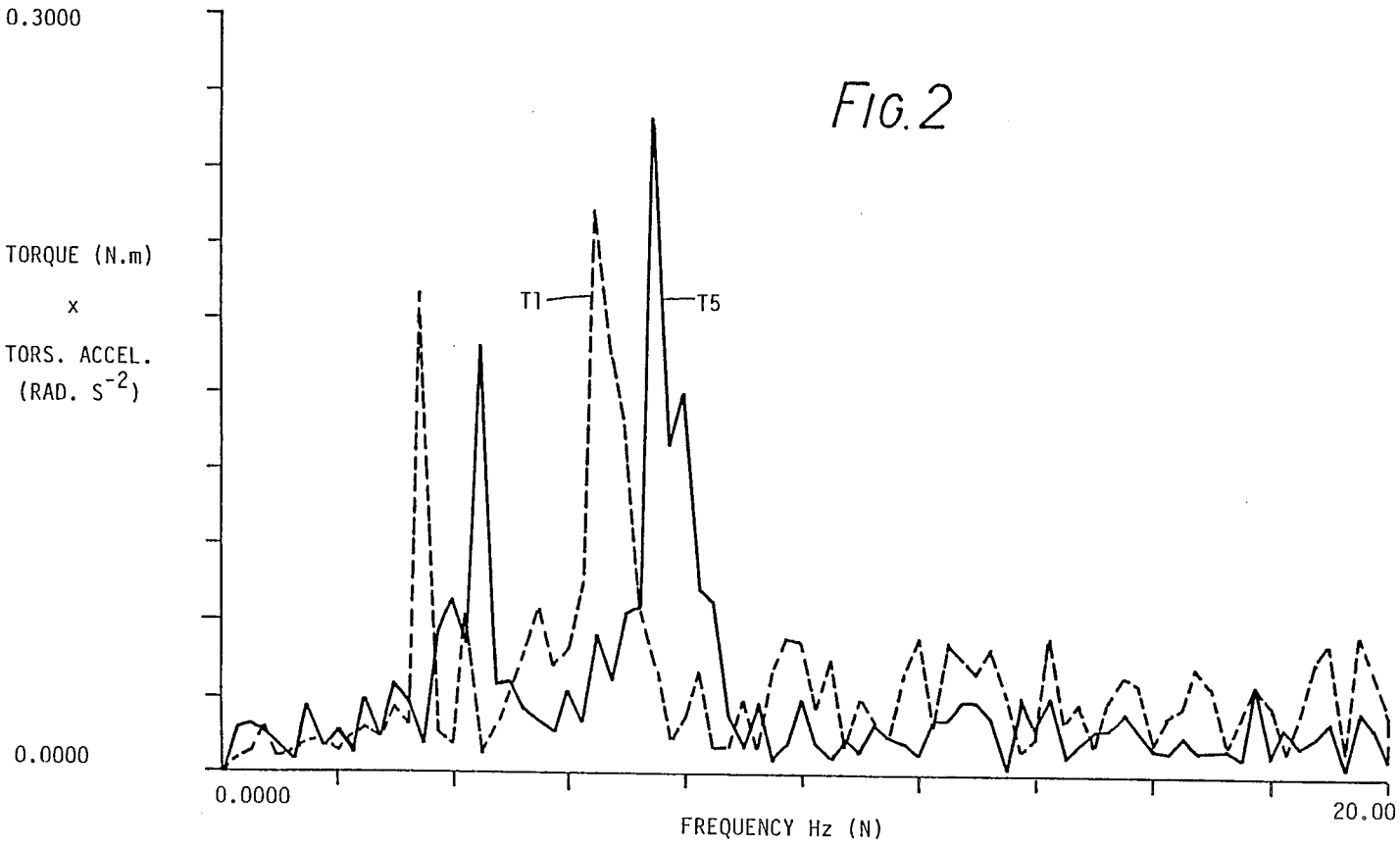

FIG. 2 shows the effect of wear on bit. Torque and torsional acceleration have been multiplied together and the resulting amplitude plotted against frequency. In this and all the remaining Figures, frequencies are normalizted relative to bit speed of rotation. The units are indicated as Hz(N), i.e. normalized Hertz. Thus in FIG. 2, frequencies range from zero up to 20 x bit rate of rotation. Two curves are plotted, as labelled T1 for a $\frac{1}{8}$th worn bit and the other labelled T5 for a $\frac{5}{8}$th worn bit. There is a good peak in T1 at about 6.5 Hz(N) and another peak at about 3.5 Hz(N). In T5 these have shifted up to about 7.5 Hz(N) and 4.5 Hz(N) respectively.

Figure 3:
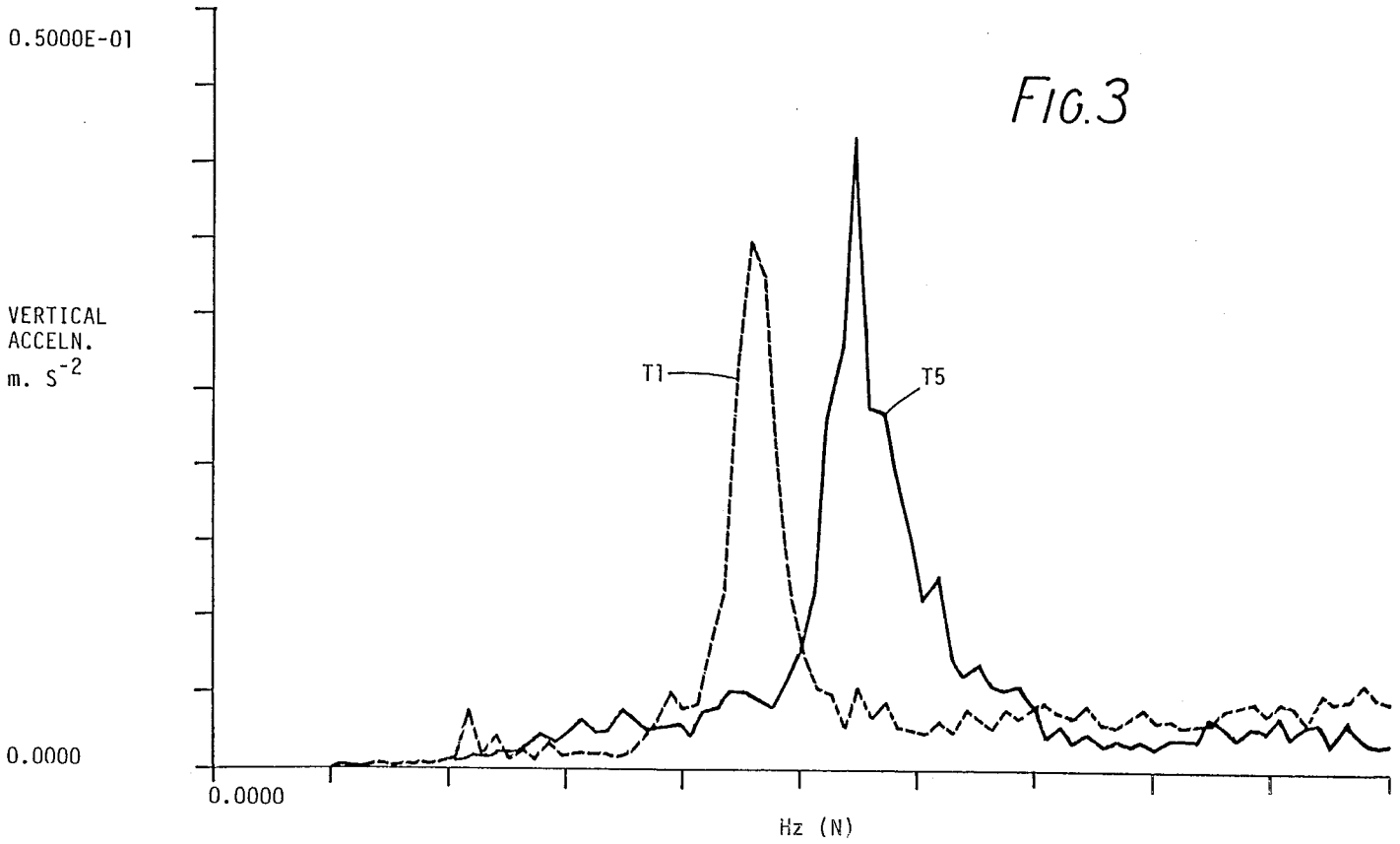

FIG. 3 shows a similar pair of frequency domain curves for vertical acceleration over the interval 0 to 40 Hz(N) for T1 and T5 bits drilling in limestone.

Figure 4:
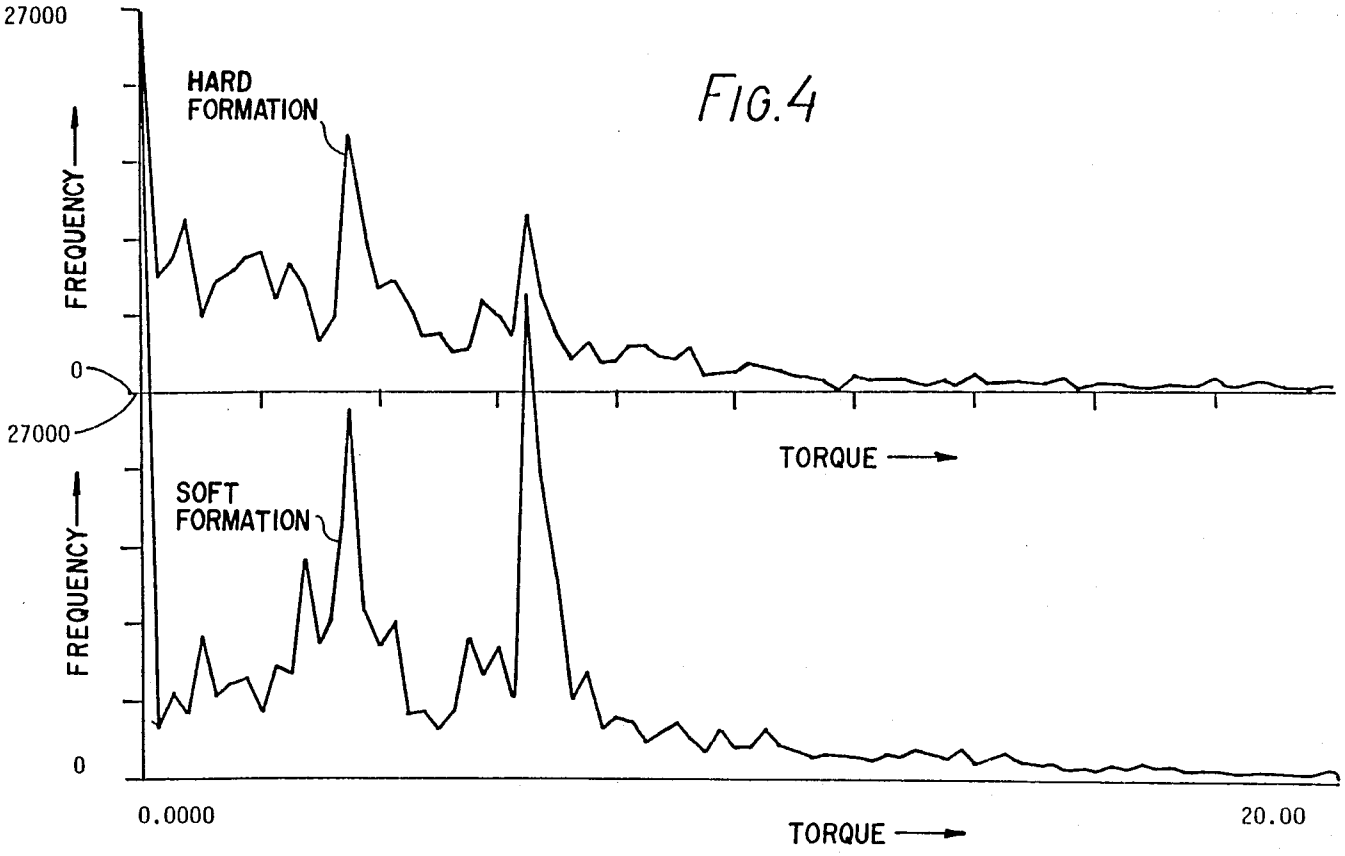

FIG. 4 shows frequency domain torque curves obtained from the same bit (a T1 bit) drilling in soft and hard formations. The same general form of spectrum results but the peaks are noticeably higher for the soft formation. Note that the peaks are not looked at in any fixed window; as FIGS. 2 and 3 show the significant peaks will shift with wear. Rather, the peaks are looked at in the frequency spectrum, wherever they occur.

Figure 5:
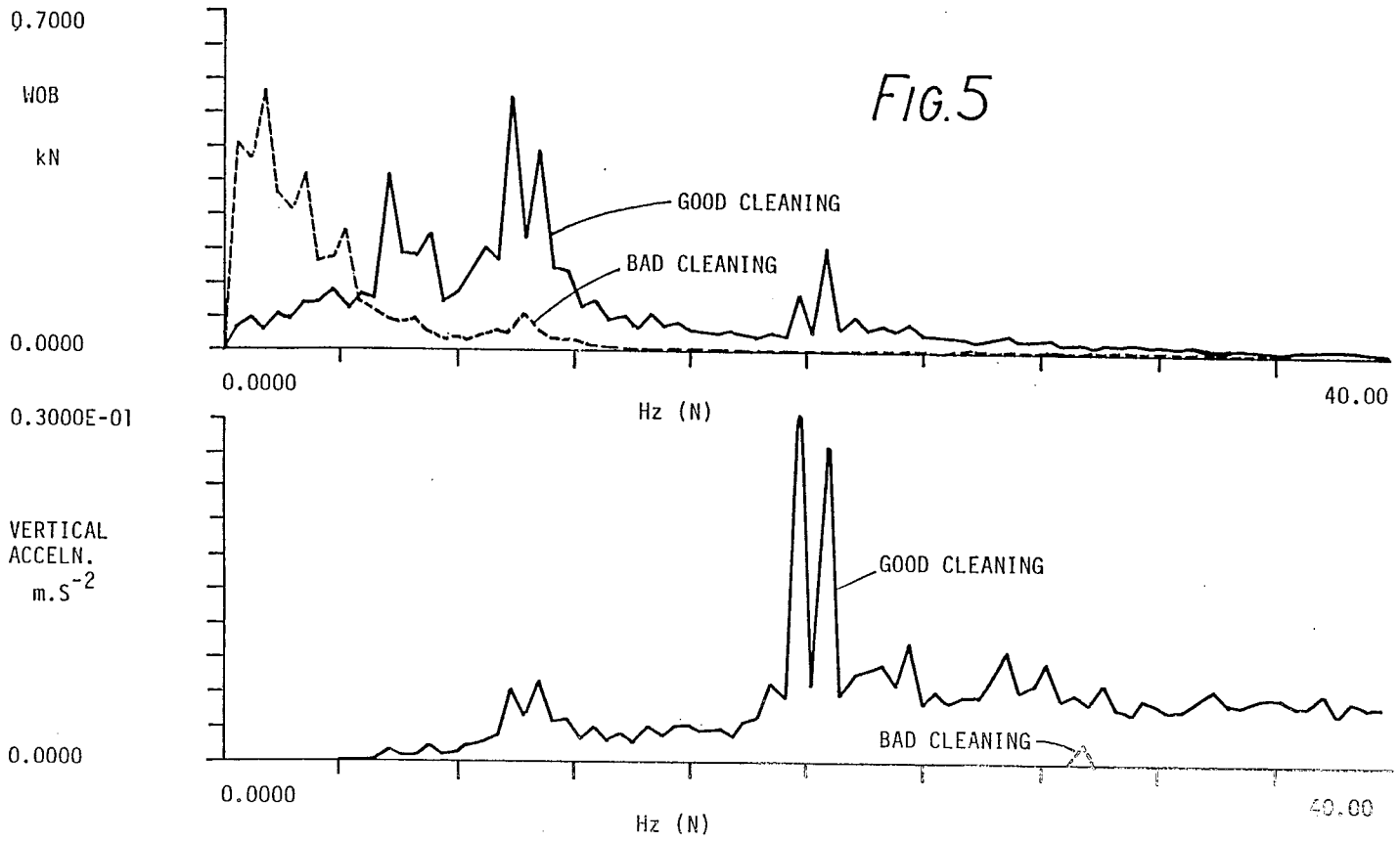

FIG. 5 shows the difference between a bit cutting in limestone with good cleaning and an overloaded bit which is not cleaning well but tends to rotate a plug of compacted rock with it. With good cleaning, the vertical acceleration frequency domain curve shows well defined peaks as the teeth do their work in the rock. With poor cleaning, the vertical acceleration energy has virutually disappeared. With good cleaning, WOB exhibits corresponding peaks. With poor cleaning, the peaks all but disappear and WOB is concentrated near zero frequency (static weight).

Figure 6:
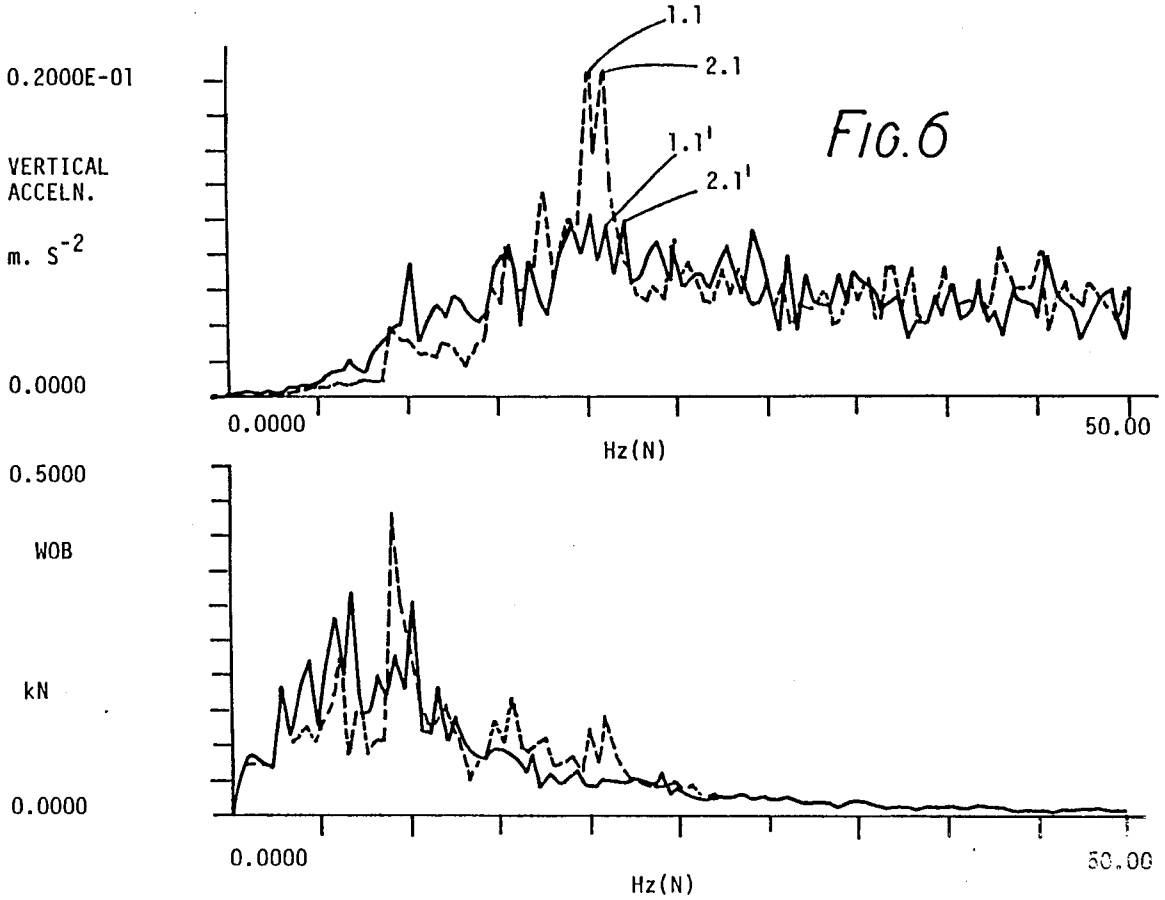

FIG. 6 shows vertical acceleration and WOB frequency domain curves for drilling in limestone with a new bit and a bit which is only one eight worn but has two teeth missing and a worn guage. The new bit has very pronounced peaks denoted 1.1 arising from the first tooth row of the first cone and 2.1, arising from the second tooth row of the first cone. Although the worn bit is only worn a little as a whole, the first cone has been damaged and there are two teeth missing in the first row and the second (middle) row is 27% worn. The result is that the peaks, now denoted 1.1′ and 2.1′, have become very much less pronounced, as well as shifting up in frequency. The WOB curves are less easy to interpret, although a significant qualitative change is apparent.

Figure 7:
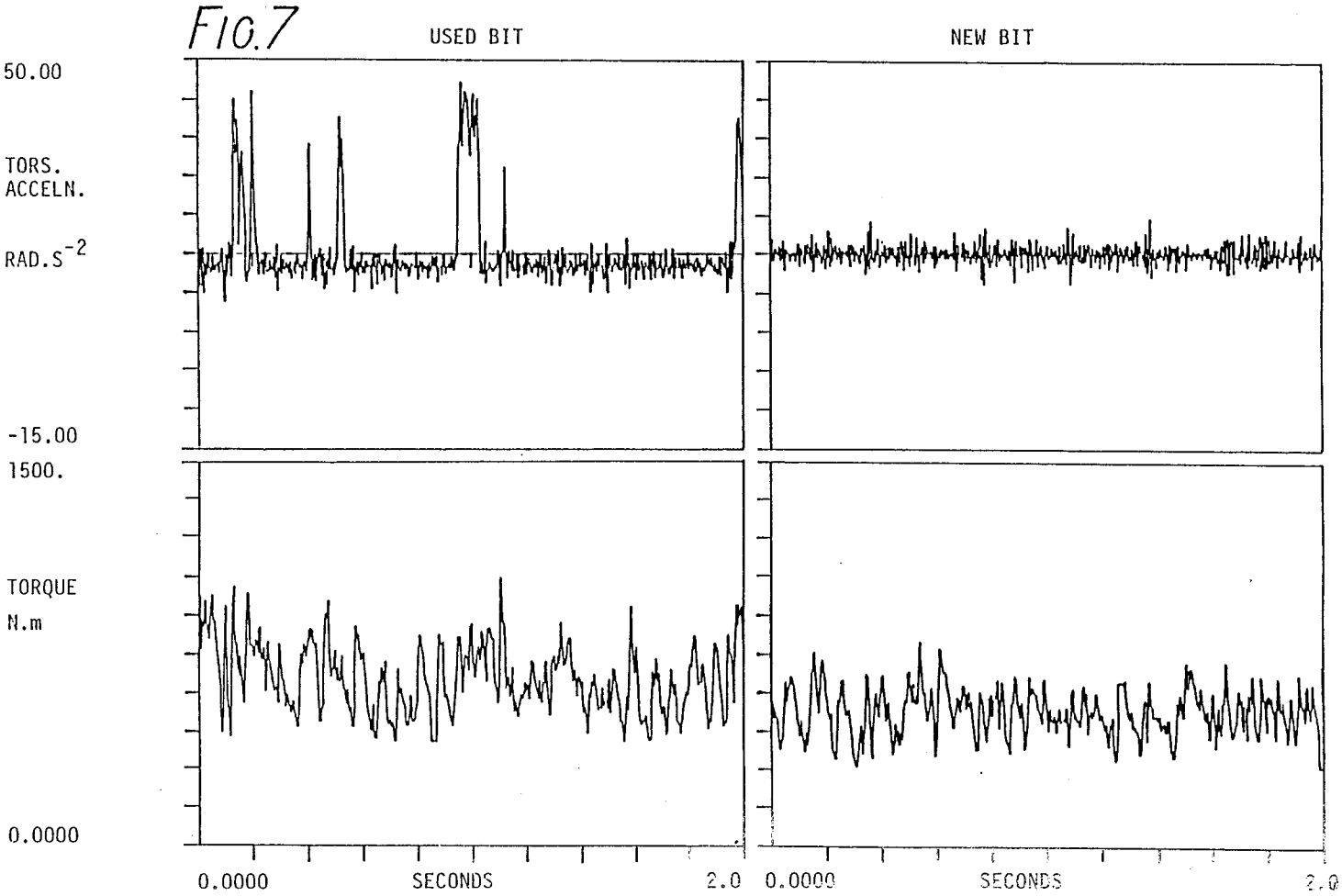

FIG. 7 shows time domain curves illustrating the effect of drilling marble using a new bit (right hand side) and a used bit with one cone stuck (left hand side). The bottom curves plot torque which exhibits a general increase in level, which by itself is not especially informative. It would be difficult to draw a clear influence from the torque curves. However, the top curves show torsional acceleration and the curve for the used bit exhibits some pronounced unidirectional (non oscillatory) peaks which are characteristic of a stuck cone. The evidence of this curve gives a strong indication that the string must be pulled out for attention to the bit, an indication which is reinforced by consideration of the two curves together. In this matter information is most readily obtained from time domain curves but it is possible to obtain useful information from frequency domain curves which will show abnormal amounts of low frequency torsional acceleration.

What is claimed is:

1. A method of drilling a borehole in an earth formation with a rotating drilling system including a drill bit including the steps of:

sensing at least one physical quantity associated with the interaction of the drilling system with the earth formation with at least one transducer and generating at least one oscillatory output signal in response thereto;

determining the frequency spectrum of said oscillatory signal;

monitoring the frequency spectrum to detect a characteristic of the frequency spectrum which is indicative of a property of the drilling system/earth formation interaction and detecting a frequency shift thereof; and controlling the drilling process in response to the detected frequency shift.

2. A method according to claim 1 further including the steps of determining the rate of bit rotation and of normalizing the frequency spectrum relative to the rate of bit rotation.

3. A method according to claim 1 wherein the at least one transducer includes a plurality of transducers each of which senses one physical quantity, and said oscillatory signal is formed from the combination of output signals from at least two of said plurality of transducers.

4. A method according to claim 1 or 3, wherein the at least one transducer senses one or more of the following physical quantities; weight on bit, torque, torsional acceleration, vertical acceleration, transverse acceleration, transverse stress, and standpipe pressure.

5. A method according to claim 1 wherein the output signals from the at least one transducer are dvided into successive sampling intervals, and are averaged over a plurality of said sampling intervals.

6. A method according to claim 5, wherein the output signal is accumulated as a plurality of digital samples and the frequency spectrum is derived by means of a discrete Fourier transform.

7. A method according to claim 1 or 6, wherein said characteristic is a peak in the frequency spectrum and a shift in said peak is monitored to detect bit tooth wear.

8. A method according to claims 1 or 6, wherein change in amplitude of a peak in the frequency spectrum is monitored to indicate rock hardness.

9. A method according to claim 8, wherein indicated rock hardness is correlated with at least one of rate of penetration, weight on bit or torque to provide an indication of drilling conditions.

10. A method according to claim 8, wherein said at least one transducer senses torque and the change of amplitude is detected in the frequency spectrum derived from the output signal of said torque sensing transducer.

11. A method according to claims 1 or 6, wherein said at least one transducer senses weight on bit, and changes of peak amplitudes in the frequency spectrum derived from the output signal of said weight on bit sensing transducer are monitored to detect a bit with bad cleaning.

12. A method according to claim 3 wherein the step of forming the product of output signals further includes the step of multiplying together said plurality of signals to enhance features common to said signals.

13. A method of analyzing the process of forming a borehole with a drilling bit, the method including the steps of deriving oscillatory signals from a plurality of transducers sensing physical quantities associated with the formation of the borehole, at least one of said physical quantities including torsional acceleration of the bit, detecting unidirectional peaks in the torsional acceleration of the bit and, in response to the detection of said unidirectional peaks, identifying a malfunctioning bit cone.

14. A method of drilling a borehole with a rotating drill bit including the steps of:

sensing at least one physical quantity associated with the drilling process with at least one transducer and generating at least one oscillatory output signal in response thereto;

determining the frequency spectrum of said oscillatory signal;

detecting peaks in the frequency spectrum and monitoring the abrupt appearance and disappearance of said peaks as an indication of an abnormally functioning drill bit; and controlling the drilling process in response to the abrupt appearances and disappearances of said peaks.

* * * * *